US006684977B2

(12) United States Patent
Stuart

(10) Patent No.: US 6,684,977 B2
(45) Date of Patent: Feb. 3, 2004

(54) SPEAKER RETENTION ASSEMBLY FOR AN ACTIVE NOISE CONTROL SYSTEM

(75) Inventor: Philip Edward Arthur Stuart, Chatham (CA)

(73) Assignee: Siemens VDO Automotive, Inc., Chatham (CA)

( * ) Notice: Subject to any disclaimer, the term of this patent is extended or adjusted under 35 U.S.C. 154(b) by 0 days.

(21) Appl. No.: 10/218,610

(22) Filed: Aug. 14, 2002

(65) Prior Publication Data

US 2003/0047380 A1 Mar. 13, 2003

Related U.S. Application Data

(60) Provisional application No. 60/318,948, filed on Sep. 13, 2001.

(51) Int. Cl.[7] ..... F01N 1/06

(52) U.S. Cl. ..... 181/206; 181/206; 181/175; 181/198; 181/199

(58) Field of Search ..... 181/242, 206, 181/148, 153, 224, 222, 252, 256, 175, 198, 199; 381/71.5, 86, 333, 391

(56) References Cited

U.S. PATENT DOCUMENTS

| | | | | | |
|---|---|---|---|---|---|
| 952,164 | A | * | 3/1910 | Wood | 181/242 |
| 1,177,617 | A | * | 4/1916 | Gray | 181/242 |
| 2,346,394 | A | * | 4/1944 | Rettinger | 181/198 |
| 2,520,706 | A | * | 8/1950 | Anderson et al. | 181/242 |
| 3,576,232 | A | * | 4/1971 | Lebert | 181/206 |
| 3,936,606 | A | | 2/1976 | Wanke | |
| 4,410,065 | A | | 10/1983 | Harvey | |
| 4,565,905 | A | | 1/1986 | Nation | 381/186 |
| 4,665,549 | A | | 5/1987 | Eriksson et al. | |
| 4,876,722 | A | | 10/1989 | Dekker et al. | |
| 4,947,434 | A | | 8/1990 | Ito | |
| 5,170,019 | A | | 12/1992 | Lee | |
| 5,229,556 | A | | 7/1993 | Geddes | |
| 5,319,165 | A | | 6/1994 | Geddes | |
| 5,336,856 | A | | 8/1994 | Krider et al. | |
| 5,426,703 | A | | 6/1995 | Hamabo et al. | |
| 5,426,705 | A | | 6/1995 | Yokota et al. | |
| 5,432,857 | A | | 7/1995 | Geddes | |
| 5,446,249 | A | | 8/1995 | Goodman et al. | |
| 5,446,790 | A | | 8/1995 | Tanaka et al. | |

(List continued on next page.)

FOREIGN PATENT DOCUMENTS

| | | |
|---|---|---|
| EP | 0884471 | 6/1998 |

OTHER PUBLICATIONS

Specification for U.S. Ser. No. 10/056 322 filed Jan. 24, 2002.

*Primary Examiner*—Robert Nappi
*Assistant Examiner*—Renata D McCloud

(57) ABSTRACT

An air introduction system (10) provides an active noise control system which includes a speaker assembly (28) in which the speaker support ring (36) is mounted to a speaker housing (32) without fasteners. In one speaker assembly, the speaker housing includes a plurality of extensions (40) which extend radially from an outer periphery of the speaker housing (32). The speaker support ring includes an edge (42) which at least partially surrounds the extensions (40). In another speaker assembly, the speaker support ring (50) includes a plurality of apertures (52) through a flange (54) which closely fits a speaker housing (32). The housing edge (54) and the speaker protection cone edge (56) are heated to a melting point of the material and the speaker support ring (50) is sandwiched therebetween. Heated material from the housing edge and the speaker protection cone edge pass through the apertures (52) to provide an effective bond therebetween. Another speaker assembly includes a speaker support ring having a plurality of teeth (66) which engage the outer periphery of the speaker housing.

17 Claims, 4 Drawing Sheets

U.S. PATENT DOCUMENTS 5,457,749 A 10/1995 Cain et al.
5,466,899 A 11/1995 Geisenberger
5,513,266 A 4/1996 Zuroski
5,541,373 A 7/1996 Cheng
5,550,334 A 8/1996 Langley
5,587,563 A 12/1996 Yazici et al.
5,693,918 A 12/1997 Bremigan et al.
5,828,759 A 10/1998 Everingham
6,084,971 A 7/2000 McLean
6,085,864 A * 7/2000 Copeland et al. ..... 181/242

* cited by examiner

SPEAKER RETENTION ASSEMBLY FOR AN ACTIVE NOISE CONTROL SYSTEM

The present application claims priority to U.S. Provisional Patent Application Ser. No. 60/318,948, filed Sep. 13, 2001.

BACKGROUND OF THE INVENTION

The present invention relates to an air introduction system, and more particularly to an active noise control speaker mounting arrangement.

Manufacturers have employed active and passive methods to reduce engine noise within the passenger compartment. Such noise frequently emanates from the engine, travels through the air induction system and emanates out of an inlet of the air intake into the passenger compartment.

Active systems use a speaker to create a canceling sound that attenuates engine noise. The sound created is out of phase with the engine noise and combines with this noise to result in its reduction. Generally, this sound is generated in proximity to the inlet of the air induction system. In one such system, a control unit, such as a digital signal processor, obtains data from the vehicle engine, creates a predictive model of engine noise, and thereby generates the appropriate cancellation signal based on the results of this model. This signal is then transmitted to the speaker, which transforms this signal into a canceling sound. Because the control unit may not perfectly model engine noise, an error microphone is placed in proximity to the intake of the air induction system to determine if engine noise need be further attenuated.

Typically, the error microphone is placed near the air inlet. The speaker of the system is generally attached to the air induction system. Conventional speaker arrangements utilize a speaker support ring having a multiple of lobes. The lobes receive fasteners for attachment of the speaker to the speaker support ring. The multiple lobes result in a relatively large support ring housing which increases the speaker mounting face area. Furthermore, a large number of lobes are required to assure a proper seal of the speaker of its chamber to prevent damage caused by weathering including snow, mud, ice, stones, leaves insects, and other environmental conditions.

Accordingly, it is desirable to provide a mounting arrangement without utilizing conventional fasteners for an active noise control speaker which hardens the speaker against environmental conditions while increasing the effective speaker face area.

SUMMARY OF THE INVENTION

The air introduction system according to the present invention provides an active noise control system which includes a speaker assembly. A speaker is supported by a speaker support ring which is mounted to a speaker housing. A speaker protection cone mounts to the speaker housing to further protect the speaker within the speaker housing.

In one speaker assembly, the speaker housing includes a plurality of extensions which extend radially from an outer periphery of the speaker housing. The speaker support ring includes an edge which at least partially surround the extensions. That is, a lip of the edge is substantially perpendicular to "snap" around the extensions. The speaker protection cone is attached directly to the speaker support ring.

In another speaker assembly, the speaker support ring includes a plurality of apertures through a flange which closely fits a speaker housing. This speaker assembly is assembled through heat application. The housing edge and the speaker protection cone edge are heated to a melting point of the material and the speaker support ring is sandwiched therebetween. Heated material from the housing edge and the speaker protection cone edge pass through the apertures to provide an effective bond therebetween.

Another speaker assembly according to the present invention includes a speaker support ring having a plurality of teeth along the outer periphery. The teeth face inward toward the center of the speaker support ring such that when the speaker support ring is mounted to the speaker housing the teeth engage the outer periphery thereof. A separate process may then attach the speaker protection cone to the housing.

The present invention therefore provides a mounting arrangement without utilizing conventional fasteners for an active noise control speaker which hardens the speaker against environmental conditions while increasing the effective speaker face area.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
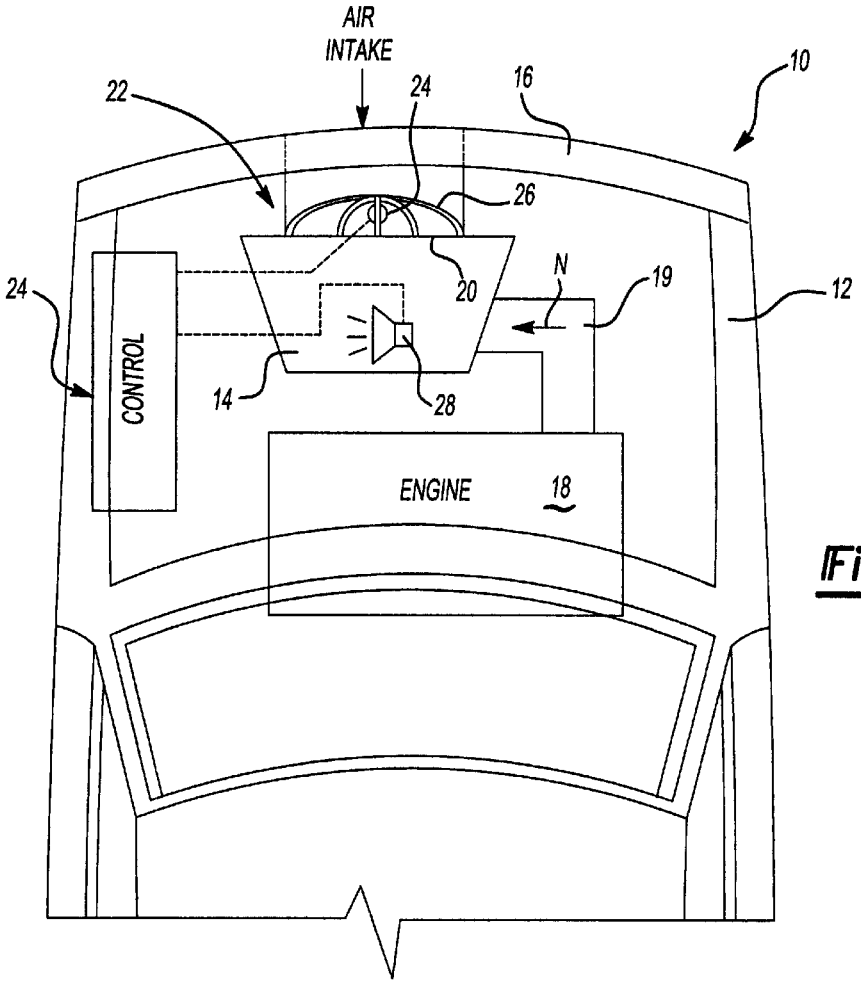
FIG. 1 is a general schematic view of an air introduction system according to the present invention.

FIG. 1 illustrates a general schematic view of an air introduction system 10 for a vehicle 12. Preferably, the air introduction system 10 includes an air introduction body 14 mounted adjacent a vehicle body component 16 such as a vehicle bumper. The air introduction body 14 intakes ambient air to communicate airflow to an engine 18 through a duct 19. As known, noise and vibration from the engine 18 emanates through the air introduction system 10. As generally known, noise and vibration from the engine 18 emanates through duct (19) of the air introduction system 10.

An active noise control system 22 is preferably mounted adjacent an inlet 20 to control engine noise which is radiated through the air introduction system 10. The active noise control system 22 preferably includes a microphone 24 mounted to a support structure 26 and a speaker assembly 28 is mounted within the duct 19 through which engine noise and vibration (illustrated schematically by arrow N) are communicated.

Figure 2:
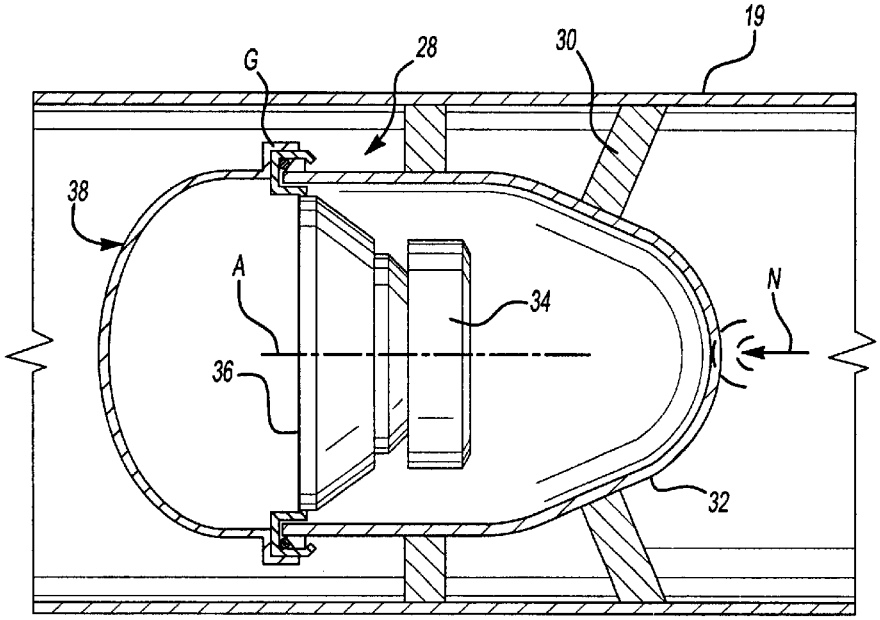
FIG. 2 is general sectional view taken along a duct axis of an air introduction body having an active noise control speaker mounted within a duct.
Figure 3:
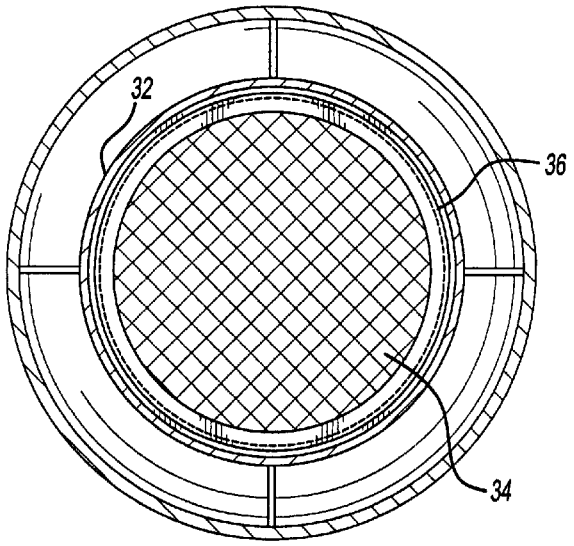
FIG. 3 is an expanded front view of the speaker assembly.

Referring to FIG. 2, a cross-section of the speaker assembly 28 is illustrated along the length of duct 19. Speaker housing supports 30 are mounted within the duct 19 to support a speaker housing 32 along an axis A which is defined along the length of duct 19. The speaker housing 32 is preferably shaped to provide minimal drag and to minimize the annular gap G between the housing 32 and duct 19. A speaker 34 is supported by a speaker support ring 36 which is mounted to the speaker housing 32. Preferably, the entire periphery of the speaker support ring 36 (also illustrated in FIG. 3) engages the housing 32 to maximize acoustic coupling between the speaker 34 and the engine noise and vibration N. A speaker protection cone 38 mounts to the speaker housing 32 downstream of the engine noise and vibration N to further protect the speaker 34 within the speaker housing 32.

Figure 4:
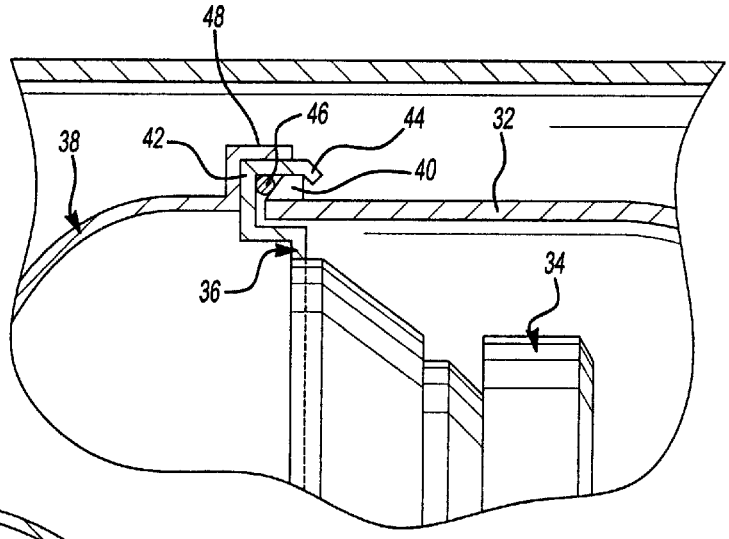
FIG. 4 is an expanded sectional view taken along a duct axis of the speaker assembly.

Referring to FIG. 4, the speaker housing 32 includes a plurality of extensions 40 which extend radially from an outer periphery of the speaker housing 32. The extensions 40 effectively provide a raised edge extending about the outer periphery of the speaker housing 32. The extensions 40 may extend about the entire outer periphery or be spaced intermittently thereabout.

The speaker ring 36 includes an edge 42 which engages the extensions 40. Preferably, the edge 42 defines a hook partially rolled edge which fits about the outer periphery of the speaker housing 32 and at least partially surrounds the extensions 40. That is, a lip 44 of edge 42 is substantially perpendicular to axis A to "snap" around extensions 40. It should be understood that lip 44 may be preformed in a the hook-like shape or may be heat formed about extensions 40 after the speaker 34 and speaker ring 36 are located on the speaker housing 32.

Figure 5:
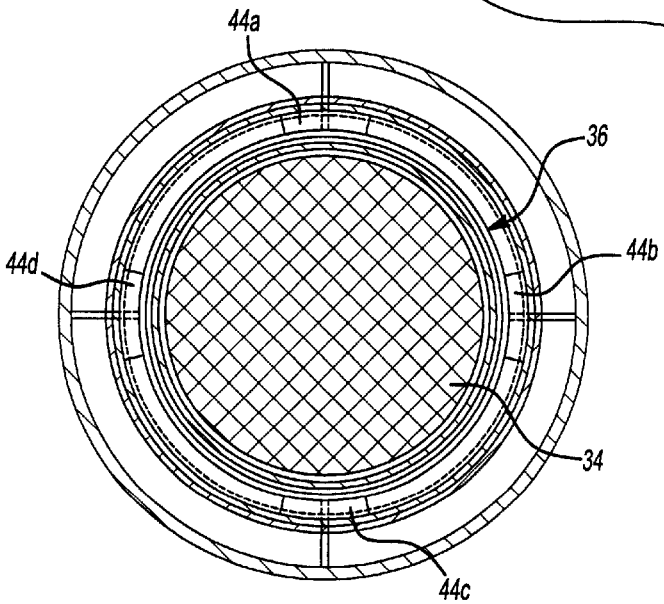
FIG. 5 is an expanded front view of another speaker assembly.

The speaker edge 42 preferably defines the lip 44 about entire periphery of the speaker ring 36. The lip 44 may alternatively be formed as lip sections 44*a*–44*d* (FIG. 5) such that apertures between the lip sections 44*a*–44*d* provide clearance for members which may extend from the speaker housing 32.

A seal 46 is located between the speaker support ring 36 and the speaker housing 32 to prevent damage caused by weathering including snow, mud, ice, stones, leaves insects, and other environmental conditions. The seal 46 is preferably mounted about the outer periphery of the extensions 40, however, other locations will also benefit from the present invention.

The speaker protection cone 38 is attached directly to the speaker support ring 36. Alternatively, the speaker protection cone 38 is mounted about the outer periphery of the speaker support ring 36 to assure engagement of the lip 44 with the extensions 40. Preferably, the inner periphery of the speaker protection cone 38 provides a lip 48 which engages the lip 44 of the speaker support ring 36 in a manner similar to the engagement of the lip 44 with the extensions 40.

Figure 6:
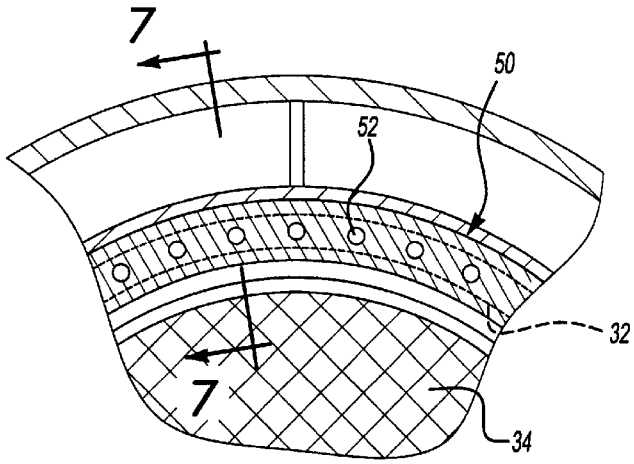
FIG. 6 is an expanded front view of another speaker assembly.
Figure 7:
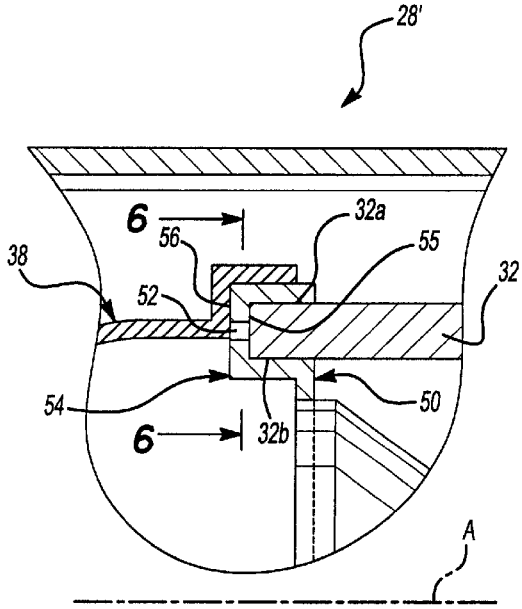
FIG. 7 is an expanded front sectional view of the speaker assembly of FIG. 6 taken along line 7—7.
Figure 8:
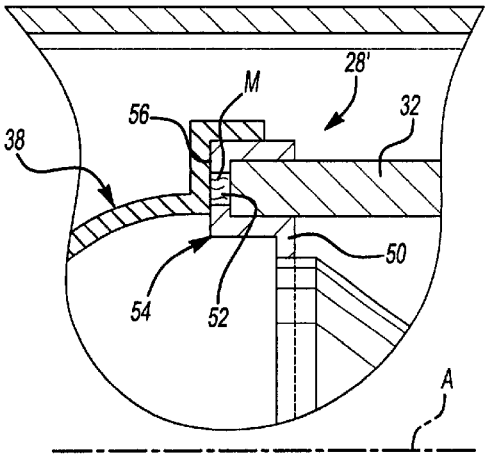
FIG. 8 is an expanded sectional view of the FIG. 8 speaker assembly after a heat melt operation.

Referring to FIG. 6, a speaker support ring 50 includes a plurality of apertures 52 defined about the outer periphery of the speaker support ring 50. Preferably the apertures 52 are located through a speaker support ring flange 54 which closely fits a speaker housing 32. The speaker housing 32 defines an outer diameter 32*a* and an inner diameter 39*b*. The speaker support ring flange 54 preferably contacts the outer diameter 32*a* and the inner diameter 32*b* of the speaker housing 32. That is, the speaker support ring flange 54 fits over a speaker housing edge 55 in a manner similar to a lid fitting on a can. When the speaker support ring 50 is fitted to the housing 32, the apertures 52 are aligned with the housing edge 55 (FIG. 7) which is substantially parallel to axis A. Referring to FIG. 7, the speaker assembly 28' is assembled through heat application. Preferably, the speaker assembly 28' components are manufactured of a non-metallic material subject to distortion through application of heat. The housing edge 55 and a speaker protection cone edge 56 of the speaker protection cone 38 are heated to a melting point of the material and the speaker support ring 50 is sandwiched therebetween. Heated material (illustrated schematically at M) from the housing edge 55 and the speaker protection cone edge 56 pass through the apertures 52 (FIG. 8) to provide an effective bond therebetween. That is, apertures 52 provide a material flow path of the melted material M to further interlock the components.

Figure 9:
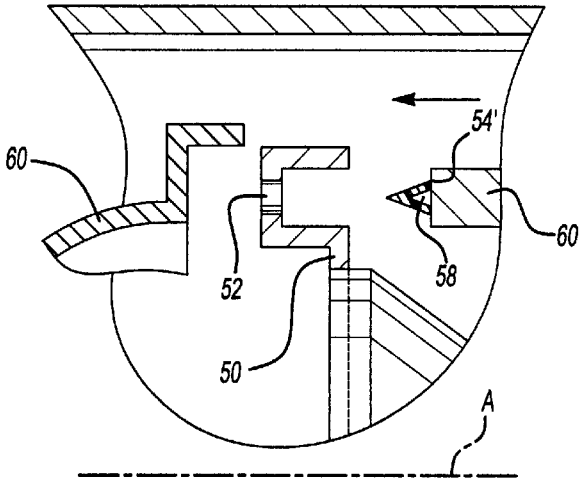
FIG. 9 is an expanded sectional view taken along a duct axis of another speaker assembly.
Figure 10:
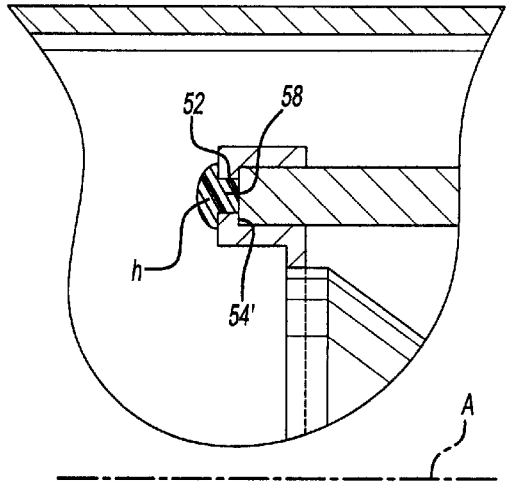
FIG. 10 is an expanded sectional view of the FIG. 9 speaker assembly after a heat melt operation.

FIG. 9 illustrates a housing edge 54' having a plurality of spike-like extensions 58 which align with apertures 52. The apertures 52 of the speaker support ring 50 receive the extensions 58 and the extensions are heated to form heat stakes h (FIG. 10) to retain the speaker support ring 50 to the speaker housing 60. Alternatively, the spike-like extensions 58 may be vibration welded to retain the speaker support ring 50 to the speaker housing 60. A separate process may then attach the speaker protection cone 62 to the housing 60.

Figure 11:
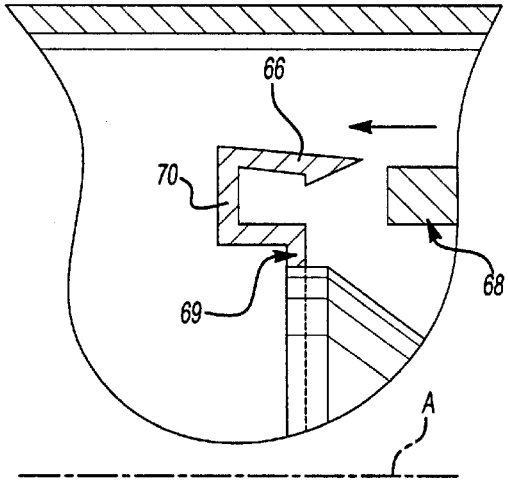
FIG. 11 is an expanded sectional view taken along a duct axis of another speaker assembly.

FIG. 11 illustrates a speaker support ring 64 having a plurality of teeth 66 along the outer periphery. The teeth 66 face inward toward the center of the speaker support ring 64 such that when the speaker support ring 64 is mounted to the speaker housing 68 the teeth engage the outer periphery thereof. That is, the teeth 66 dig into the outer periphery of the speaker housing 68. Preferably, the teeth 66 are defined along a flange 70 formed in the speaker support ring 64 as described with reference to FIG. 4. A separate process may then attach the speaker protection cone to the housing 68.

It should be understood that attachment arrangement combinations of the present invention may be intermixed in combinations other than the attachment combinations specifically disclosed in the illustrated embodiments to provide redundant or different combinations. For example only, the teeth 58 disclosed in FIG. 9 may be utilized in combination with the apertures 50 and heat staking attachment arrangement disclosed in FIG. 5. In other words, the present invention shall not be limited to only those attachment arrangements specifically disclosed in the illustrated embodiments.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. An active noise control speaker assembly comprising:

a speaker housing mounted within a duct defining an axis; and a speaker support ring mounted to an edge of said speaker housing, said speaker support ring engaged with an outer diameter and an inner diameter of said speaker housing, said speaker support ring comprises a plurality of apertures, said plurality of apertures aligned with an edge of said speaker housing in an assembled condition and at least partially filled with melted material from said edge of said speaker housing.

2. The active noise control speaker assembly as recited in claim 1, further comprising an extension radially extending from an outer periphery of said speaker housing, an edge of said speaker support ring extending at least partially around said extension to secure said speaker support ring to said speaker housing.

3. The active noise control speaker assembly as recited in claim 2, wherein said edge of said speaker support ring defines a hook.

4. The active noise control speaker assembly as recited in claim 2, wherein said edge comprises a plurality of segments.

5. The active noise control speaker assembly as recited in claim 1, wherein said apertures are located through a flange of said speaker support ring, said flange received over said speaker housing edge.

6. The active noise control speaker assembly as recited in claim 1, wherein said edge of said speaker housing comprise a plurality of spikes.

7. The active noise control speaker assembly as recited in claim 1, wherein said edge of said speaker support ring comprises a plurality of teeth which engage an outer periphery of said speaker housing.

8. The active noise control speaker assembly as recited in claim 1, further comprising a speaker protective cone mounted to said speaker support ring opposite said speaker housing.

9. The active noise control speaker assembly as recited in claim 1, further comprising a seal mounted between said speaker support ring and said speaker housing.

10. An active noise control speaker assembly comprising:

a speaker housing mounted within a duct defining an axis;

a speaker support ring comprising a plurality of apertures aligned with a speaker housing edge, said plurality of apertures provide a communication path for melted material to attach said speaker housing to said speaker support ring; and a speaker mounted to said speaker support ring.

11. The active noise control speaker assembly as recited in claim 10, further comprising a speaker protective cone mounted to said speaker support ring opposite said speaker housing, said apertures provide a communication path for melted material from said speaker protective cone and said speaker housing edge.

12. The active noise control speaker assembly as recited in claim 10, wherein said edge of said speaker housing comprise a plurality of spikes which at least partially engage said apertures.

13. An active noise control speaker assembly comprising:

a speaker housing mounted within a duct defining an axis;

an extension radially extending from an outer periphery of said speaker housing;

a speaker support ring mounted to an edge of said speaker housing, a speaker support ring edge engaged with an inner diameter of said speaker housing and said extension to secure said speaker support ring to said speaker housing; and a speaker mounted to said speaker support ring, said speaker support ring engages an outer diameter and an inner diameter of said speaker housing, said speaker support ring comprises a plurality of apertures, said plurality of apertures aligned with an edge of said speaker housing in an assembled condition and at least partially filled with melted material from said edge of said speaker housing.

14. The active noise control speaker assembly as recited in claim 13, wherein said edge defines a hook which engages said extension.

15. The active noise control speaker assembly as recited in claim 13, wherein said edge comprises a plurality of segments.

16. The active noise control speaker assembly as recited in claim 13, further comprising a speaker protective cone mounted to said speaker support ring opposite said speaker housing, said speaker protective cone at least partially engaging said edge.

17. An active noise control speaker assembly comprising:

a speaker housing mounted within a duct defining an axis; and a speaker support ring mounted to a speaker housing edge, said speaker support ring comprises a plurality of apertures, said plurality of apertures aligned with said speaker housing edge in an assembled condition, said plurality of apertures provide a communication path for melted to attach said speaker housing to said speaker support ring.

* * * * *